United States Patent [19]

Rappaport et al.

[11] Patent Number: 4,807,757

[45] Date of Patent: Feb. 28, 1989

[54] PILL DISPENSER PROVIDING SEQUENTIAL DISPENSING MEANS AND AUTOMATIC INCREMENTAL DISPENSING CONTROL

[76] Inventors: Lisa N. Rappaport, 165 W. End Ave., New York, N.Y. 10023; Bradley J. Bolnick, 36 Halley Dr., Pomona, N.Y. 10970

[21] Appl. No.: 81,650

[22] Filed: Aug. 4, 1987

[51] Int. Cl.[4] ..... B65D 83/04

[52] U.S. Cl. ..... 206/535; 206/534; 221/132; 221/133; 221/310

[58] Field of Search ..... 206/528, 533–538; 221/132, 133, 278–280, 299, 300, 310

[56] References Cited

U.S. PATENT DOCUMENTS

| | | | |
|---|---|---|---|
| 2,718,299 | 9/1955 | Atwater et al. | 221/279 |
| 2,885,116 | 5/1959 | Tregilgar | 221/279 |
| 3,126,129 | 3/1964 | Weinberg . | |
| 3,162,301 | 12/1964 | Cage, Jr. | 206/534 X |
| 3,358,818 | 12/1967 | Davis | 206/536 |
| 3,402,850 | 9/1968 | Barton et al. . | |
| 3,483,845 | 12/1969 | Hartman, Jr. | 206/534 X |
| 3,494,322 | 2/1970 | Dubbels . | |
| 3,596,629 | 8/1971 | English | 206/534 X |
| 3,678,884 | 7/1972 | Robbins . | |
| 3,854,625 | 12/1974 | Kuebler | 221/279 X |
| 4,127,190 | 11/1978 | Sunnen | 206/535 |
| 4,164,301 | 8/1979 | Thayer | 206/538 X |
| 4,245,742 | 1/1981 | Rossino | 206/534 |
| 4,288,006 | 9/1981 | Clover, Jr. | 206/538 X |
| 4,572,376 | 11/1978 | Sunnen . | |

*Primary Examiner*—Stephen Marcus
*Assistant Examiner*—Bryon Gehman
*Attorney, Agent, or Firm*—Morgan & Finnegan

[57] ABSTRACT

The invention relates to a pill dispensing device, and in particular to a device for dispensing birth control pills. The invention includes a multi-sided housing having a plurality of chambers disposed therein. Each chamber houses a plurality of pills which are dispensed one at a time through the opening of the housing by a dispensing device.

12 Claims, 2 Drawing Sheets

PILL DISPENSER PROVIDING SEQUENTIAL DISPENSING MEANS AND AUTOMATIC INCREMENTAL DISPENSING CONTROL

BACKGROUND OF THE INVENTION

The invention relates to a pill dispensing device, and in particular to a device for dispensing birth control pills. This invention relates more particularly to a multi-sided housing having an opening and including a plurality of chambers where each side of the housing forms an exterior wall of one of the chambers and each chamber can accommodate a plurality of pills disposed therein. The invention further includes dispensing means for dispensing the pills in each of the chambers through the opening of the housing.

The invention further includes means that indicate if a pill has already been taken on a given day and means that indicate which week of the month it is for pill taking purposes.

Birth control pill dispensing devices associated with the prior art suffer from the disadvantages of being cumbersome, inconvenient to carry along, and do not provide a simple and effective way for remembering to take a pill.

SUMMARY OF THE INVENTION

Hence, with the foregoing in mind, it is a primary object of the present invention to provide an improved pill dispensing device suitable for dispensing birth control pills which avoids the aforementioned drawbacks and limitations of the prior art proposals.

Another and more specific object of the present invention aims at providing a new and improved pill dispensing device which is compact and convenient to carry.

Yet a further object of the present invention aims at providing mnemonic means for taking the appropriate pill on a given day of a given week of the month.

In order to implement these and other objects as the invention, which will become more readily apparent as the description proceeds, the present invention comprises a pill dispensing device having an opening and including a plurality of chambers, wherein a plurality of pills are disposed in each of said chambers and dispensing means for dispensing the pills in each chamber through the opening of the housing.

BRIEF DESCRIPTION OF THE DRAWINGS

For a fuller understanding of the nature and objects of the invention, reference should be had to the following detailed description, taken in connection with the accompanying drawings, in which.

DETAILED DESCRIPTION OF THE PREFERRED EMBODIMENT

Figure 1:
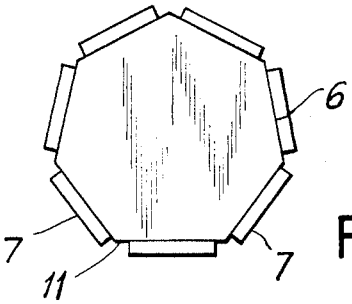
FIG. 1 is a perspective end view illustrating an embodiment of the present invention.
Figure 2:
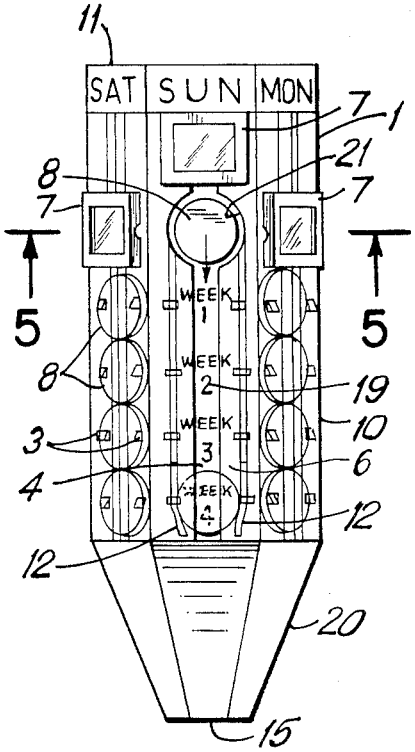
FIG. 2 is a perspective view illustrating an embodiment of the present invention.

Referring now to the drawings, FIGS. 1 and 2 illustrate the preferred embodiment of the present invention.

Figure 3:
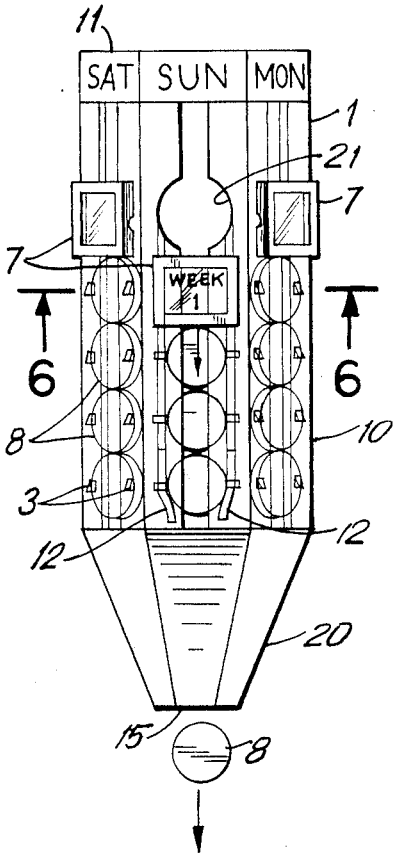
FIG. 3 is a perspective view illustrating an embodiment of the present invention showing a pill being dispensed.
Figure 4:
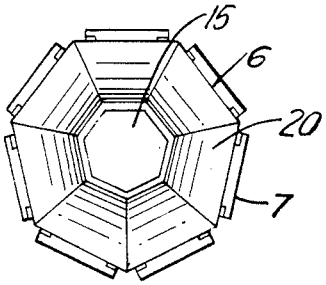
FIG. 4 is a perspective end view.

As shown in FIGS. 2 and 3, the present invention has a multi-sided, compact sized shape. the housing 1 is preferably the size of a pen, thus making it compact and easy to carry. In addition, the invention is capable of being held in and dispensed by one hand.

Further, the invention can be formed as a one piece integral unit which is disposable after all the pills 8 have been dispensed. FIG. 2 shows an embodiment wherein openings 21 are provided on each of the seven sides for loading the pills 8 into the chambers 6. Alternatively, the housing 1 can have a removable top portion so that each of the chambers 6 can be refilled with pills 8.

FIG. 1 shows a top end view of the present invention where the housing 1 of the present invention is preferably formed as a seven sided configuration, each side forming an exterior sidewall of a chamber 6 of the housing 1. While FIGS. 1–8 show a seven sided housing 1 having seven chambers 6 disposed therein, it is understood that the number of sides and the corresponding number of chambers may vary as desired.

As shown in FIG. 2, the housing 1 has an upper portion 10 within which the chambers 6 are located. The chambers 6 extend to the bottom of the upper position 10 of the housing 1. Directly beneath and connected to the upper portion 10 is a bottom portion 20. The bottom portion 20 is hollow and conically shaped and has an opening 15 at its bottom. When a pill 8 is dispensed from one of the chambers 6, the pill is dropped into the bottom portion 20 and exits out of the housing 1 through the opening 15.

Each chamber 6 has a plurality of pills 8 disposed therein. The pills 8 are vertically stacked atop one another within each of the chambers 6. Each chamber 6 represents a different day of the week and the indica 11 located on each exterior side wall of each chamber 6 indicates the day of the week (FIG. 2) and is arranged in a counterclockwise order, although it can also be arranged clockwise. Thus, each chamber 6 of the housing 1 corresponds to a different day of the week. It is preferable to also color code the exterior side of each chamber 6 to denote a specific day of the week. For example the exterior sidewall of the chamber 6 containing pills to be taken on Saturday could be colored yellow, Sunday - green, etc. This along with the day of the week indica 11 provides the pill taker with a means for remembering the correct pill to take. In addition, indicia 19 located along the longitudinal length of each track 4 denotes the week of the month, e.g. week 1, week 2, etc. (FIG. 2)

Each chamber 6 has retaining means such as leaf springs 12 within which the vertically stacked pills 8 are held in place in each chamber 6 until they are dispensed one at a time.

Figure 5:
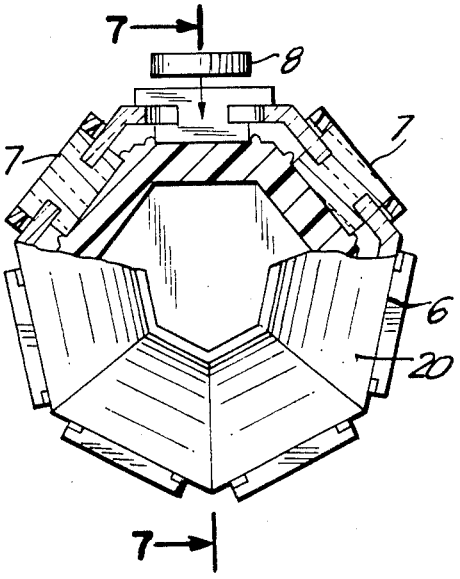
FIG. 5 is a sectional view taken along lines 5—5 of FIG. 2.
Figure 6:
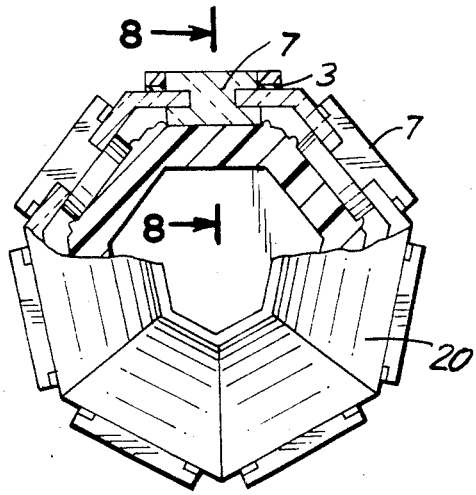
FIG. 6 is a sectional view taken along lines 6—6 of FIG. 3.
Figure 7:
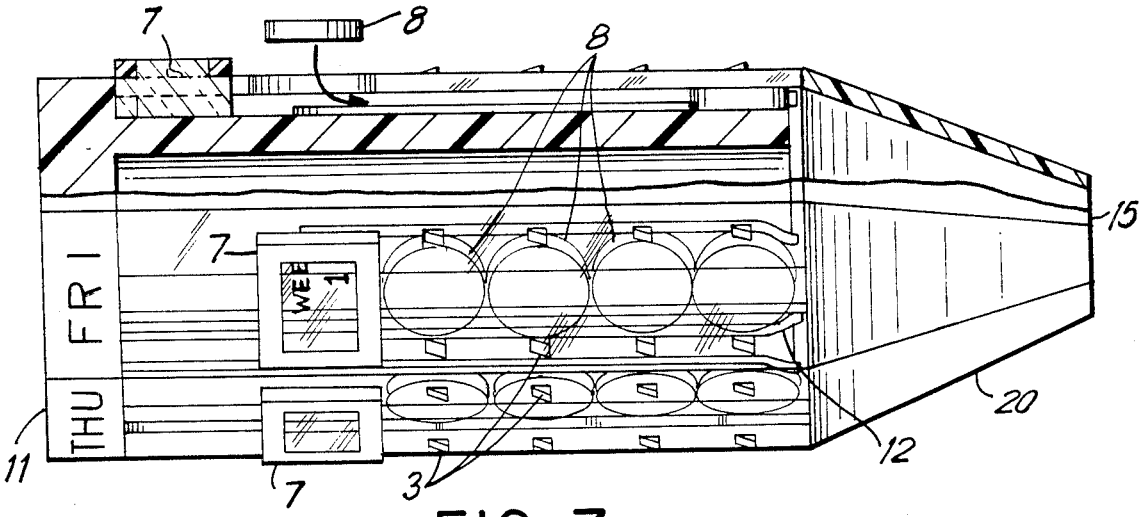
FIG. 7 is a perspective view taken along lines 7—7 of FIG. 5 showing the path a pill takes along one of the chambers.

The pills are dispensed by dispensing means such as a pusher 7 which moves along a track 4 disposed on each exterior sidewall of said housing 1 as shown in FIG. 5. There are seven pushers 7 and seven tracks 4, each being associated with one of the chambers 6 and providing the dispensing means for the pills 8 disposed inside of each of the associated chambers 6. Small resistance tabs 3 are located on both sides of each track 4 and serve to retard and to stop the downward movement of the pusher 7 so that only one pill 8 is dispensed at a time. The resistance tabs 3 are preferably made of a flexible material such as plastic or rubber.

Figure 8:
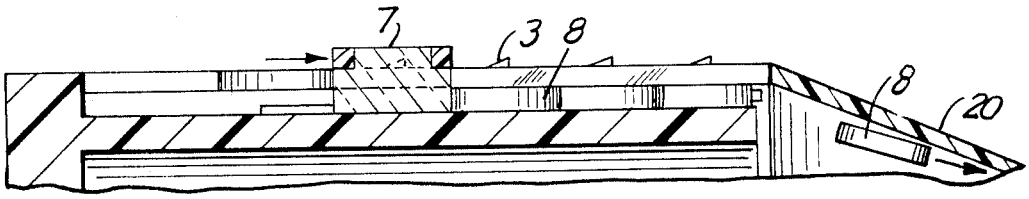
FIG. 8 is a partial perspective view taken along lines 8—8 of FIG. 6.

FIG. 8 shows the direction of movement of the pusher 7 and of the pills 8. As the pusher 7 moves downward it exerts pressure on the top of the uppermost pill 8 which in turn exerts pressure on the pill underneath it and so on. The pusher 7 moves downward one pill length where it's movement is arrested by the resistance tabs 3. The bottommost pill 8 is pushed out of the leaf springs 12 where it falls out of the hole 15 in the bottom portion 20 of the housing 1.

The pusher 7 is preferably made of transparent material so that the indica 19 indicating the week of the month is visible.

A further modification of the present invention is to provide a locking mechanism which returns the last activated pusher 7 to it's top position when the next pusher 7 is activated for dispensing. Locking mechanisms of this type are known in the art such as the 4 Color Pen manufactured by BIC Corp., Item MMXPI.

Although the present invention has been designed specifically for birth control pills, it is understood that the invention is not limited solely to that particular application. Other applications for the present invention are possible with the appropriate modifications thereto. e.g. vitamin pills, medicine.

We do not limit ourselves to say any particular details of construction set forth in the specification and illustrated in the accompanying drawings, for the same refers to and sets forth only one embodiment of the invention, and it is observed that the same may be modified without departing from the spirit and scope of the invention.

Having thus described the invention, what we claim as new and desire to be secured by Letters Patent is as follows:

1. A pill dispensing device comprising:

a housing having a plurality of pill-retaining chambers extending axially thereof, each of said chambers being proportioned to hold a predetermined number of pills stacked edge-to-edge therein and formed with a dispensing opening;

a pair of opposed retaining rails mounted in the interior of each said chamber and extending along opposite sides thereof, each said pair of retaining rails adapted to retain said predetermined number of pills stacked edge-to-edge therebetween, each said pair of retaining rails having lower ends which are resiliently biased so as to move away from each other to release the lower-most pill in its corresponding stack in response to downward force exerted on said corresponding stack and allow the lower-most pill to pass through the dispensing opening of its corresponding chamber, said lower ends returning to their original position when said downward force is removed so as to prevent release of a next pill;

a vertical guide track for each said chamber formed on the exterior of said housing;

a unitary dispensing element mounted to each said guide track and slidable along the length thereof, each said dispensing element formed with an exterior portion projecting outwardly from its corresponding guide track and an integral interior portion projecting into its corresponding chamber, each said dispensing element being accessible from the exterior of said housing and being downwardly translatable in response to downward pressure so as to cause said interior portion to bear upon the upper-most pill in its corresponding stack;

resistance means disposed on the exterior of said housing, said resistance means adapted to permit each said dispensing element to translate downwardly along its corresponding guide track in response to downward pressure applied thereto yet generally stop further downward travel and hold said dispensing element in place on said corresponding guide track after each in a series of predetermined incremental downward movements, such that, during downward movement of each said dispensing element, the lower ends of its corresponding pair of retaining rails will move away from each other in response to force exerted by said dispensing element so as to release the lower-most pill in its corresponding stack from said corresponding retaining rails and allow the lower-most pill to pass through the dispensing opening in its corresponding chamber, said lower ends essentially immediately moving back towards each other to prevent a further pill from being released from said corresponding retaining rails and thereby ensure that only one pill at a time will be dispensed from said corresponding chamber.

2. A pill dispensing device according to claim 1, wherein said housing is formed from an upper portion and an integral lower portion, said upper portion providing said plurality of chambers, said lower portion having an opening therein substantially in registry with the dispensing opening of each said chamber.

3. A pill dispensing device according to claim 1, wherein said housing is formed in a seven-sided cylindrical configuration, each of said seven sides forming an exterior sidewall defining one of said chambers and on which one of said guide tracks is formed.

4. A pill dispensing device according to claim 2, wherein said resistance means comprises a plurality of aligned pairs of resistance tabs formed on said exterior sidewall of each said chamber, one resistance tab in each said pair being disposed on each side of its corresponding guide track, each said pair of resistance tabs being spaced from the next lowest pair a distance of approximately one pill diameter and adapted to releasably engage its corresponding dispensing element so as to act as a stop to resist further movement of said corresponding dispensing element and provide incremental downward movement thereof.

5. A pill dispensing device according to claim 4 further comprising indica located on each of said tracks, said indicia denoting a week number of the month.

6. A pill dispensing device according to claim 3, wherein each of said sidewalls has an opening so that each of said chambers can be resupplied with additional pills.

7. A pill dispensing device according to claim 3 further comprising indicia located on each of said sidewalls denoting a day of the week.

8. A pill dispensing device according to claim 7 wherein the indica denoting the days of the week on said sidewalls are arranged in a counterclockwise order.

9. A pill dispensing device according to claim 7 wherein the indica denoting the days of the weeks on said sidewalls are arranged in clockwise order.

10. A pill dispensing device according to claim 3, wherein each of said sidewalls has a distinct color denoting a day of the week.

11. A pill dispensing device according to claim 1 wherein said housing is formed as a one piece integral unit so that it can be disposed after all of said pills have been dispensed.

12. A pill dispensing device according to claim 1 wherein said housing includes a removable top portion so that said chambers of said housing can be reloaded with pills

* * * * *